United States Patent [19]

Kasai et al.

[11] Patent Number: 4,703,502

[45] Date of Patent: Oct. 27, 1987

[54] STEREO SIGNAL REPRODUCING SYSTEM

[75] Inventors: Junichi Kasai, Yokohama; Hiroshi Imai, Yokosuka; Hiroshi Tsuda, Yokohama, all of Japan

[73] Assignee: Nissan Motor Company, Limited, Japan

[21] Appl. No.: 823,250

[22] Filed: Jan. 28, 1986

[30] Foreign Application Priority Data

Jan. 28, 1985 [JP] Japan ..... 60-9029[U]
Feb. 7, 1985 [JP] Japan ..... 60-22360
May 22, 1985 [JP] Japan ..... 60-77053[U]

[51] Int. Cl.[4] ..... H04R 5/00
[52] U.S. Cl. ..... 381/24; 381/86
[58] Field of Search ..... 381/24, 27, 86, 104, 381/105, 109

[56] References Cited

U.S. PATENT DOCUMENTS 4,509,184 4/1985 Yanagawa ..... 381/24
4,521,906 6/1983 Kahn ..... 381/24

*Primary Examiner*—Forester W. Isen
*Attorney, Agent, or Firm*—Lowe, Price, LeBlanc, Becker & Shur

[57] ABSTRACT

A system for reproducing stereophonic signals to create a stereophonic sound image in front of each of listeners sitting side by side in a compartment. The system includes a right-hand loudspeaker positioned relative to the right of the first listener sitting on the right, a left-hand loudspeaker positioned relative to the left of the second listener sitting on the left, and a center loudspeaker positioned between the right- and left-hand loudspeakers. A signal generator generates R and L stereophonic signals. The R signal is applied to drive the right- and left-hand loudspeakers. The L signal is fed to drive the center loudspeaker. The signal generator includes a circuit for attenuating the R signal to the right-hand loudspeaker and a circuit for attenuating the R signal to the left-hand loudspeaker.

8 Claims, 10 Drawing Figures

STEREO SIGNAL REPRODUCING SYSTEM

BACKGROUND OF THE INVENTION

This invention relates to a system for acoustical reproductions of stereophonic signals and, more particularly, to a stereo signal reproducing system suitable in use for listeners sitting side by side in a compartment such for example as a vehicle compartment.

It is well known in the art that right- and left-hand loudspeakers be positioned, with a proper space, at the same distance with respect to a listener in order to achieve high-quality acoustical reproductions of stereophonic signals. In some cases, however, it is difficult to satisfy this requirement. This is true particularly in reproducing stereophonic signals for listeners sitting side by side in a relatively small compartment such for example as a vehicle compartment.

Therefore, the present invention provides an apparatus for acoustical reproductions of stereophonic signals which can produce a stereophonic sound image at a proper location in front of each of listeners sitting side by side in a compartment, thereby providing significantly more listening pleasure.

SUMMARY OF THE INVENTION

There is provided, in accordance with the present invention, a system for reproducing stereophonic signals to create a stereophonic sound image in front of each of first and second listeners sitting side by side in a compartment. The system comprises a right-hand loudspeaker positioned relative to the right of the first listener sitting on the right, a left-hand loudspeaker positioned relative to the left of the second listener sitting on the left, and a center loudspeaker positioned between the right- and left-hand loudspeakers. A signal generator circuit generates R and L stereophonic signals. One of the R and L signals is applied to drive the right- and left-hand loudspeakers. The other signal is applied to drive the center loudspeaker. The signal generator circuit includes a first control means for controlling the magnitude of the one signal to the right-hand loudspeaker and a second control means for controlling the magnitude of the one signal to the left-hand loudspeaker.

In another aspect of the invention, there is provided a system for reproducing stereophonic signals to create a stereophonic sound image in front of each of first, second, third and fourth listeners sitting in a compartment. The first and second listener sit on right- and left-hand front seats. The third and fourth listeners sit on right- and left-hand rear seats. The system comprises a right-hand front loudspeaker positioned relative to the right of the first listener, a left-hand front loudspeaker positioned relative to the left of the second listener, a center front loudspeaker positioned between the right- and left-hand front loudspeakers, a right-hand rear loudspeaker positioned relative to the right of the third listener, a left-hand rear loudspeaker positioned relative to the left of the fourth listener, and a center rear loudspeaker positioned between the right and left-hand rear loudspeakers. A signal generator circuit generates R and L stereophonic signals. One of the R and L signals is applied to drive the right- and left-hand front loudspeakers and also the right- and left-hand rear loudspeakers. The other signal is applied to drive the center front loudspeaker and the center rear loudspeaker. The signal generator circuit includes a first means for attenuating the one signal to the right- and left hand front loudspeakers and also to the right- and left-hand loudspeakers. The signal generator circuit also includes a second means for attenuating sound produced from the right- and left-hand rear loudspeakers and a third means for attenuating sound from the center rear loudspeaker.

In still another aspect of the invention. there is provided a system for reproducing stereophonic signals to create a stereophonic sound image in front of each of first and second listeners sitting side by side in a compartment. The system comprises a right-hand loudspeaker positioned relative to the right of the first listener sitting on the right, a left-hand loudspeaker positioned relative to the left of the second listener sitting on the left, and a center loudspeaker positioned between the right- and left-hand loudspeakers. A signal generator circuit generates R and L stereophonic signals. One of the R and L signals is applied to drive the right- and left-hand loudspeakers. The other signal is applied to drive the center loudspeaker. The signal generator circuit includes a means for providing a predetermined time delay to one of the R and L signals to reduce a difference between the time at which sound produced from the right-hand loudspeaker arrives at the first listener and the time at which sound produced from the center loudspeaker arrives at the first listener and a difference between the time at which sound produced from the left-hand loudspeaker arrives at the second listener and the time at which sound produced from the center loudspeaker arrive at the second listener.

BRIEF DESCRIPTION OF THE DRAWINGS

The present invention will be described in greater detail by reference to the following description taken in connection with the accompanying drawings, in which.

DETAILED DESCRIPTION OF THE INVENTION

Figure 1:
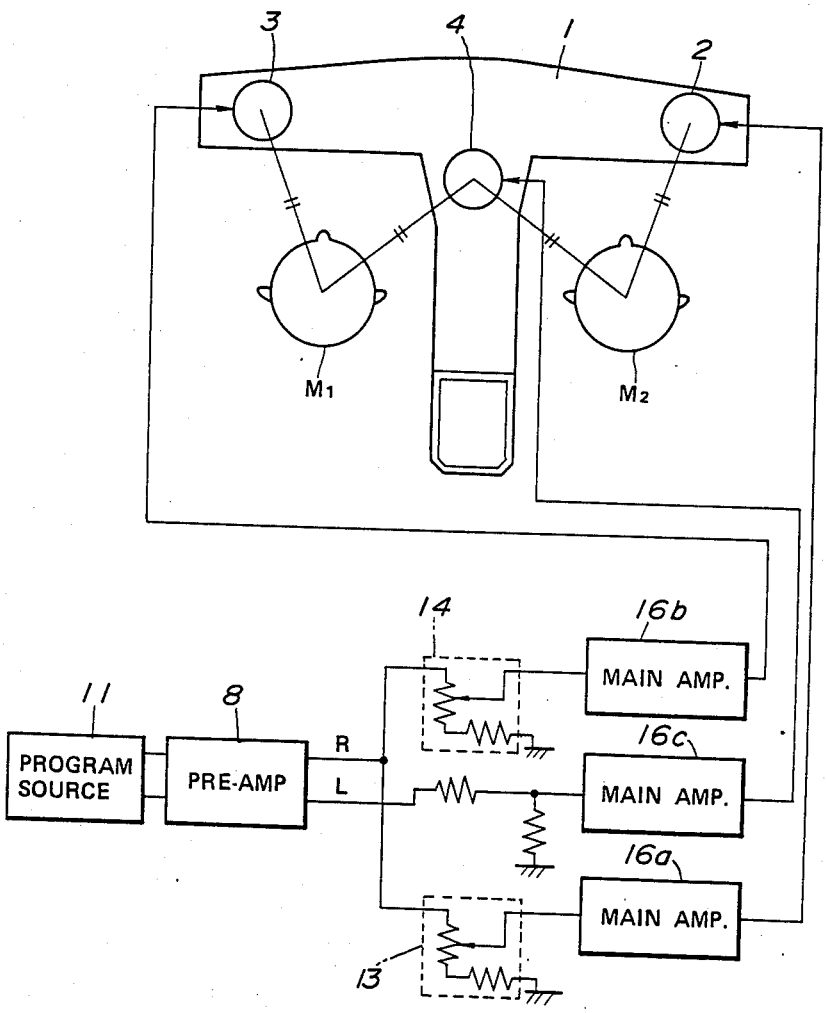
FIG. 1 is a schematic diagram showing one embodiment of a stereophonic signal reproduction system made in accordance with the present invention.

With reference to the drawings, wherein like numerals refer to like parts in the several views, and in particular to FIG. 1, the reference numeral 1 designates an instrument panel on which two loudspeakers 2 and 3 are mounted at suitable positions. The right-hand loudspeaker 2 is located relative to the right of the right-hand front seat on which a passenger M1 sits. The left-hand loudspeaker 3 is located relative to the left of the left-hand front seat on which a passenger M2 sits. A center loudspeaker 4 is located on the instrument panel 1 between the righ- and left-hand loudspeakers 2 and 3 in such a fashion that the right-hand and center loudspeakers 2 and 4 are positioned at the same distance with respect to the passenger M1 and the left-hand and center loudspeakers 3 and 4 are positioned at the same distance with respect to the passenger M2. The loudspeakers 2, 3 and 4 are connected to receive stereophonic signals from a stereophonic signal generator circuit for acoustical reproductions of stereophonic sound corresponding to the received stereophonic signals.

The signal generator circuit includes a pre-amplifier 12 which receives stereophonic signals from a program source 11 for converting the received signals into right (or R) and left (or L) electrical signals. The program source may be a cassette tape player, a compact disc player, a stereo tuner, or the like. The R signal is fed through an R-channel circuit to drive the right-hand loudspeaker 2. The R-channel circuit includes a balance controller 13 and a main amplifier **16*a* connected in series with each other. The balance controller 13 may be taken in the form of a variable resistor connected between the R-channel output of the pre-amplifier 12 and electrical ground. The movable contact of the variable resistor is connected to the main amplifier 16*a* which drives the right-hand loudspeaker 2. The R signal is also fed from the pre-amplifier 12 through another R-channel circuit to drive the left-hand loudspeaker 3. Similarly. the R channel circuit includes a balance controller 14 and a main amplifier 16*b* connected in series with each other. The balance controller 14 may be taken in the form of a variable resistor connected between the R-channel output of the pre-amplifier 12 and electrical ground. The movable contact of the variable resistor is connected to the main amplifier 16*b* which drives the left-hand loudspeaker 3. The L signal is fed through an L-channel circuit to drive the center loudspeaker 4. The L-channel circuit includes an attenuating circuit and a main amplifier 16*c* connected in series with each other. The attenuation circuit attenuates the L signal at a small attenuation factor. The attenuating circuit may be taken in the form of a voltage divider connected between the L-channel output of the pre-amplifier 12 and electrical ground. The voltage divider has resistors 15*a* and 15*b*. The junction of the resistors 15*a* and 15*b* are connected to the main amplifier 16*c* which drives the center loudspeaker 4**.

Each of the balance controllers 13 and 14 can be operated, independently of the other, to vary the volume of sound produced from the corresponding loudspeaker. Assuming now that the passenger M1 shifts his vehicle seat forward or rearward, he moves to a position with respect to which the right-hand and center loudspeakers 2 and 4 are located at different distances, degrading the listening quality of stereophonic sound. To achieve high stereophonic sound listening quality, the passenger M1 may operate the balance controller 13 in a manner to re-establish proper tone balance. This operation has no effect on the tone balance for the other passenger M1.

Figure 2:
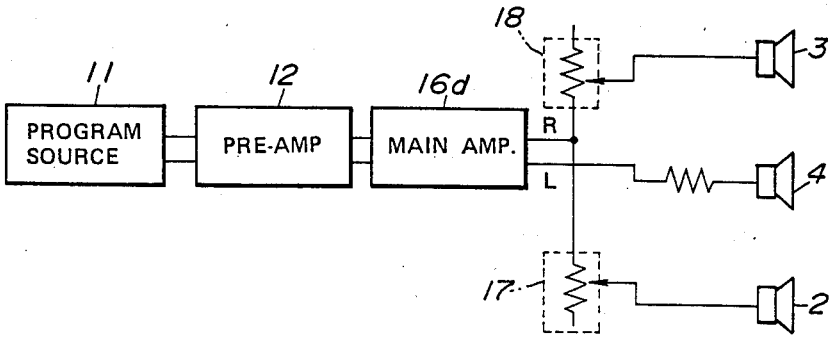
FIG. 2 is a circuit diagram showing a modified from of the signal generator circuit of FIG. 1.

FIG. 2 shows a modified form of the stereophonic signal generator circuit which employs a single main amplifiers **16*d* in order to reduce the number of main amplifiers in the acoustic driver circuit and reduce the cost thereof. The main amplifier 16*d* receives L and R signals from the pre-amplifier 12. The main amplifier 16*d* has an R-channel output coupled to the right-hand loudspeaker 2 through a balance controller 17 and also to the left-hand loudspeaker 3 through a balance controller 18. The L channel output of the main amplifier 16*d* is coupled through an attenuating circuit to the center loudspeaker 4**.

Figure 3:
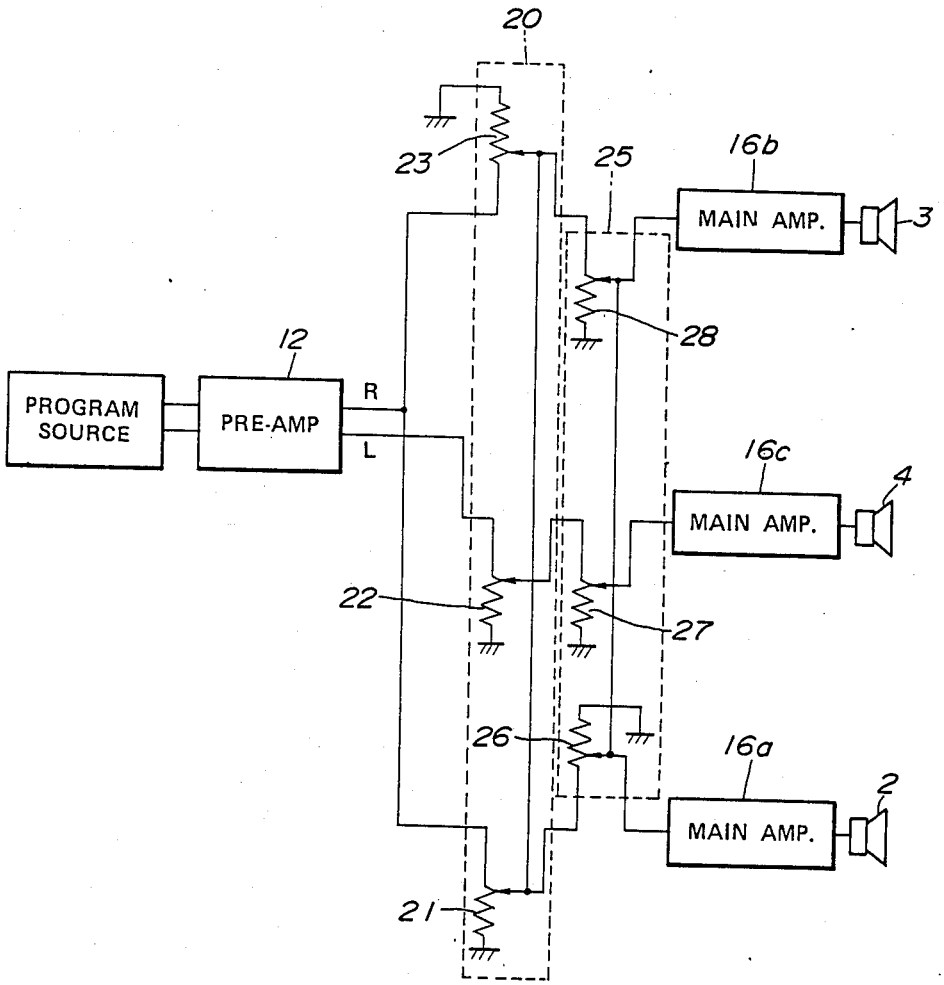
FIG. 3 is a circuit diagram showing another modified form the signal generator circuit of FIG. 1.

FIG. 3 shows another modified form of the stereophonic signal generator circuit which is substantially similar to that of FIG. 1 except for the arrangement of the balance control circuit. In this modification, the balance control circuit includes first and second balance controllers 20 and 25 for the passengers M1 and M2 seated on the right- and left-hand vehicle seats, respectively.

The first balance controller 20 includes drivingly associated variable resistors 21, 22 and 23. The variable resistor 21 is connected between the R-channel output of the pre-amplifier 12 and electrical ground. The variable resistor 22 is connected between the L-channel output of the pre-amplifier 12 and electrical ground. The variable resistor 23 is connected between the R-channel output of the pre-amplifier 12 and electrical ground. similarly, the second balance controller 25 includes drivingly associated variable resistors 26, 27 and 28. The variable resistor 26 is connected between the movable contact of the variable resistor 21 and electrical ground. The movable contact of the variable resistor 26 is connected through the main amplifier **16*a* to the right-hand loudspeaker 2. The variable resistor 27 is connected between the movable contact of the variable resistor 22 and electrical ground. The movable contact of the variable resistor 27 is connected through the main amplifier 16*c* to the center loudspeaker 4. The variable resistor 28 is connected between the movable contact of the variable resistor 23 and electrical ground. The movable contact of the variable resistor 28 is connected through the main amplifier 16*b* to the left-hand loudspeaker 3**.

The variable resistors 21, 22 and 23 of the first balance controller 20 are drivingly associated in such a fashion that when the first balance controller 20 is operated in a direction increasing the volume of sound produced from the right-hand loudspeaker 3, the volumes of sound produced from the left-hand and center loudspeaker 3 and 4 decrease at the same rate, and vice versa when the first balance controller 20 is operated in the opposite direction. Similarly, the variable resistors 26, 27 and 28 of the second balance controller 25 are drivingly associated in such a fashion that when the second balance controller 25 is operated in a direction increasing the volume of sound produced from the left-hand loudspeaker 3, the volumes of sound produced from the right-hand and center loudspeakers 2 and 4 decrease at the same rate, and vice versa when the second balance controller 25 is operated in the opposite direction.

Assuming now that the passenger M1 shifts his vehicle seat forward or rearward, he moves to a position with respect to which the right-hand and center loudspeakers 2 and 4 are located at different distances, degrading the listening quality of stereophonic sound. In order to achieve high stereophonic sound listening quality, the passenger M1 may operate the first balance controller 20 in a manner to re-establish proper tone balance. This operation has no effect on the tone balance for the other passenger M2 although it causes a change of the volumes of sound produced from the left-hand and center loudspeakers 3 and 4 to the same level. A similar operation is made when the passenger M2 operates the second balance controller 25.

It is to be noted that the R signal may be coupled to drive the center loudspeaker 4 in which case the L signal is coupled to drive the right- and left-hand loudspeakers 2 and 3. In addition, the stereo signal reproducing system of this embodiment may be used for listeners seating on the rear seat. This embodiment permits a listener to create a stereophonic sound image in front of the listener independently of the sound image localization for the other listener by adjusting the volume of sound produced from the corresponding loudspeaker after he shifts his seat.

Figure 4:
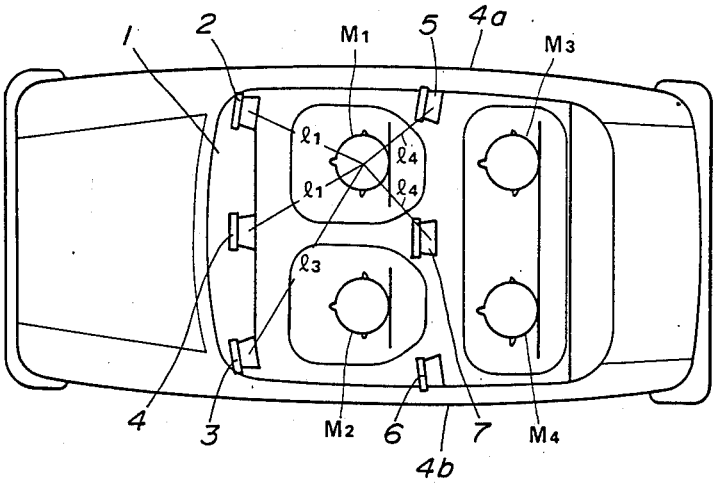
FIG. 4 is a top plan view showing the positions of listeners seating in a vehicle compartment.
Figure 5:
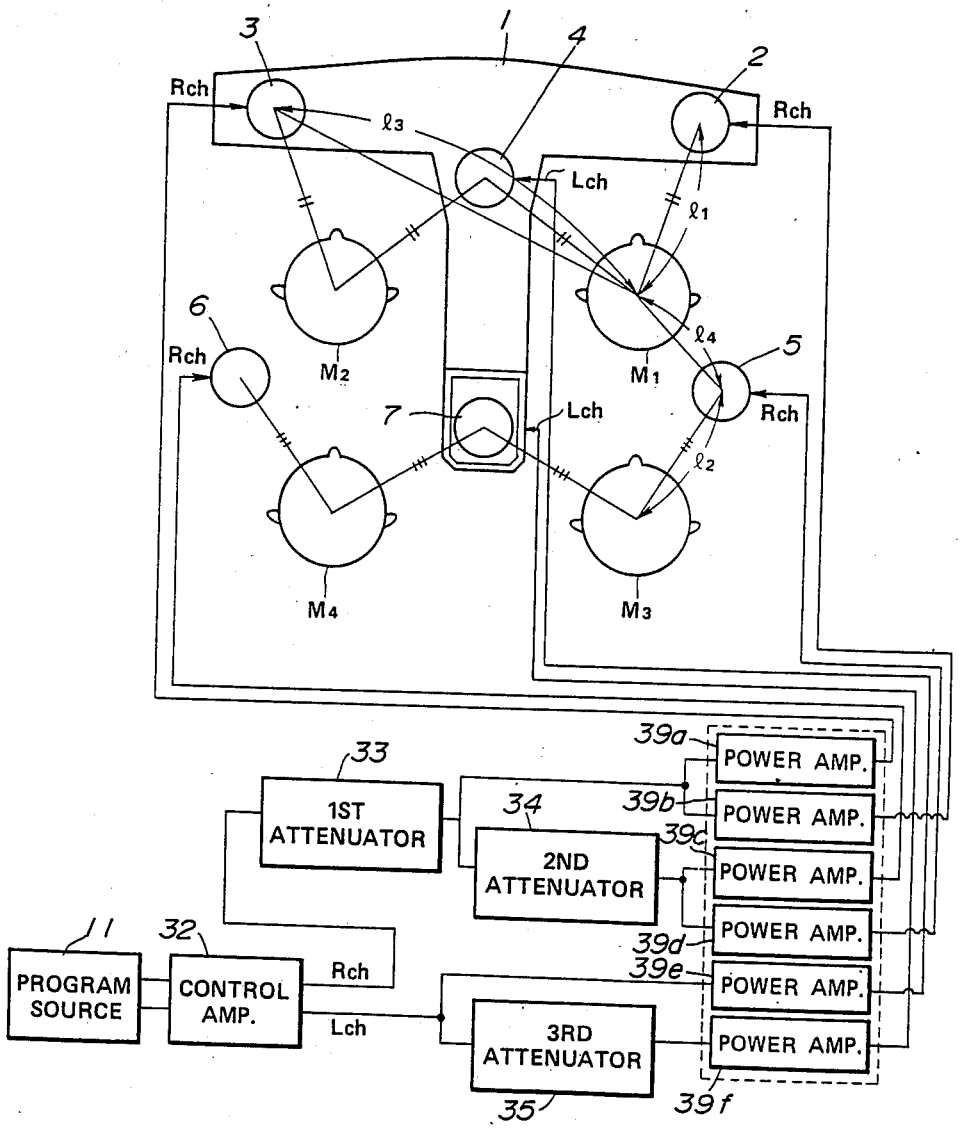
FIG. 5 is a schematic diagram showing a second embodiment of the present invention.

Referring to FIGS. 4 and 5, there is illustrated a second embodiment of the present invention which employs three loudspeakers 5, 6 and 7. In addition to the front loudspeakers 2, 3 and 4, for passengers M3 and M4 seating on the right- and left-hand rear seats. The front loudspeakers 2, 3 and 4 are located on the instrument panel 1 in a manner substantially similar to the first embodiment of FIG. 1. The right-hand loudspeaker 2 has a primary acoustical axis directed to the passenger M1 and the left-hand loudspeaker 3 has a primary acoustical axis directed to the passenger M2. The right-hand and center loudspeakers 2 and 4 are positioned at the same distance ($l_1$) relative to a passenger M1 seated on the right-hand front seat. Similarly, the left-hand and center loudspeakers 3 and 4 are positioned at the same distance ($l_1$) relative to a passenger M2 seated on the left-hand front seat. The right-hand loudspeaker 5 is located relative to the right of the right-hand rear seat. The left-hand loudspeaker 6 is located relative to the left of the left-hand rear seat. The right-hand rear loudspeaker 5 has a primary acoustical axis directed to the passenger M3 and the left-hand rear loudspeaker 7 has a primary acoustical axis directed to the passenger M4. The loudspeakers 5 and 6 may be mounted on the vehicle rear doors, respectively. The center loudspeaker 7 is located on the rear end portion of the center console in such a fashion that the right-hand and center loudspeakers 5 and 7 are positioned at the same distance ($l_2$) relative to a passenger M3 seating on the right-hand rear seat and the left-hand and center loudspeakers 6 and 7 are positioned at the same distance ($l_2$) relative to a passenger M4 seated on the left-hand rear seat. The loudspeakers 2 to 7 are connected to receive stereophonic signals from a stereophonic signal generator circuit for acoustical reproductions of stereophonic sound corresponding to the stereophonic signals.

The stereophonic signal generator circuit includes a control amplifier 32 connected to a program source 11 such as a cassette tape player, a stereo tuner, a compact disc player, or the like. The control amplifier 32 generated R and L signals at its R- and L-channel outputs, respectively. The R signal is fed through an R-channel circuit to the right- and left-hand loudspeakers 2, 3, 5 and 6. The L signal is fed through an L-channel circuit to the center loudspeakers 4 and 7. The R-channel circuit includes a first attenuating circuit 33 which is connected directly to power amplifiers 39*a* and 39*b* and also through a second attenuating circuit 34 to the power amplifiers 39*c* and 39*d*. The power amplifier 39*a* drives the left-hand front loudspeaker 3, the power amplifier 39*b* drives the right-hand front loudspeaker 2, the power amplifier 6 drives the left-hand rear loudspeaker 6, and the power amplifier 39*d* drives the right-hand rear loudspeaker 5. The L-channel circuit connects the L signal directly to a power amplifier 19*e* and also through a third attenuating circuit 35 to a power amplifier 39*f*. The power amplifier 39*e* drives the center front loudspeaker 4, and the power amplifier 39*f* drives the center rear loudspeaker 7.

With respect to the passenger M1 seater on the right-hand front seat, the front loudspeakers 2 and 4 are positioned at the same distance ($l_1$) and the loudspeaker 3 is positioned at a distance ($l_3$) greater than the distance ($l_1$). Consequently, the R sound recreated from the right-hand front loudspeaker 2 reaches the passenger M1 before the R sound recreated from the left-hand front loudspeaker 3. The difference ($\Delta t$) between the time at which the sound produced from the left-hand front loudspeaker 2 reaches the passenger M1 and the time at which the sound produced from the left-hand front loudspeaker 3 reaches the passenger M1 is normally several milliseconds (1 to 2 msec) and is given as:

$$\Delta t=(l_3-l_1)/Vo$$

where Vo is the sound velocity. As a result, the passenger M1 will listen the R sound as produced from the right-hand front loudspeaker 2. This is well known in the art as "harness effect".

The R sound generated from the left-hand front loudspeaker 3 is super imposed on the R sound produced from the right-hand front loudspeaker 2 to increase the R sound acoustical pressure at the passenger M1. The volume of sound produced from the center front loudspeaker 4 is greater than the volume of sound produced from any of the other loudspeakers since no attenuating circuit is placed in the line connecting its associated power amplifier 39*e* to the control amplifier 32. The acoustic pressure of the L sound produced from the center front loudspeaker 4 and the increased acoustic pressure of the R sound are well balanced at the passenger M1 so as to create a stereophonic sound image at a suitable location in front of the passenger M1. As shown in FIGS. 4 and 5, the right-hand rear loudspeaker 5 is located near the passenger M1 at a distance ($l_4$) which is smaller than the distance ($l_1$). It is, therefore, required to avoid the influence of the sound produced from the right-hand rear loudspeaker 5 on the location of the sound image created by the front loudspeakers 2 and 4. This can be achieved by the provision of the second attenuating circuit 34 which restricts the volume of sound produced from the right-hand rear loudspeaker 5 to a small level. Similar considerations are applicable for the passenger M2 seated on the left-hand front seat.

With respect to the passenger M3 seated on the right-hand rear seat, the rear loudspeakers 5 and 7 are positioned at the same distance ($l_2$). In addition. the front loudspeakers 2 and 4 are positioned in front of the respective rear loudspeakers 5 and 7. However, the passenger M3 will listen the R sound as produced from the right-hand rear loudspeaker 5 and the L sound as produced from the center rear loudspeaker 7 due to a "harness effect" since the front loudspeakers 2 and 4 are positioned at a greater distance from the passenger M3 than the respective rear loudspeakers 5 and 7. Consequently, a stereophonic sound image is located at a proper position in front of the passenger M3. The R sound generated from the right-hand front loudspeaker 2 is superimposed on the R sound produced from the right-hand rear loudspeaker 5, whereas the L sound produced from the center front loudspeaker 4 is superimposed on the L sound produced from the center rear loudspeaker 7. As a result, the acoustic pressure for the passenger M3 is substantially the same as the acoustic pressure for the passenger M1 in spite of the fact that the volumes of sound produced from the rear loudspeakers 5 and 6 are smaller than the volumes of sound produced from the front loudspeakers 2 and 4 because of the provision of the second and third attenuating circuits 34 and 35, respectively. Similar considerations are applicable for the passenger M4 seated on the left-hand rear seat.

Figure 6:
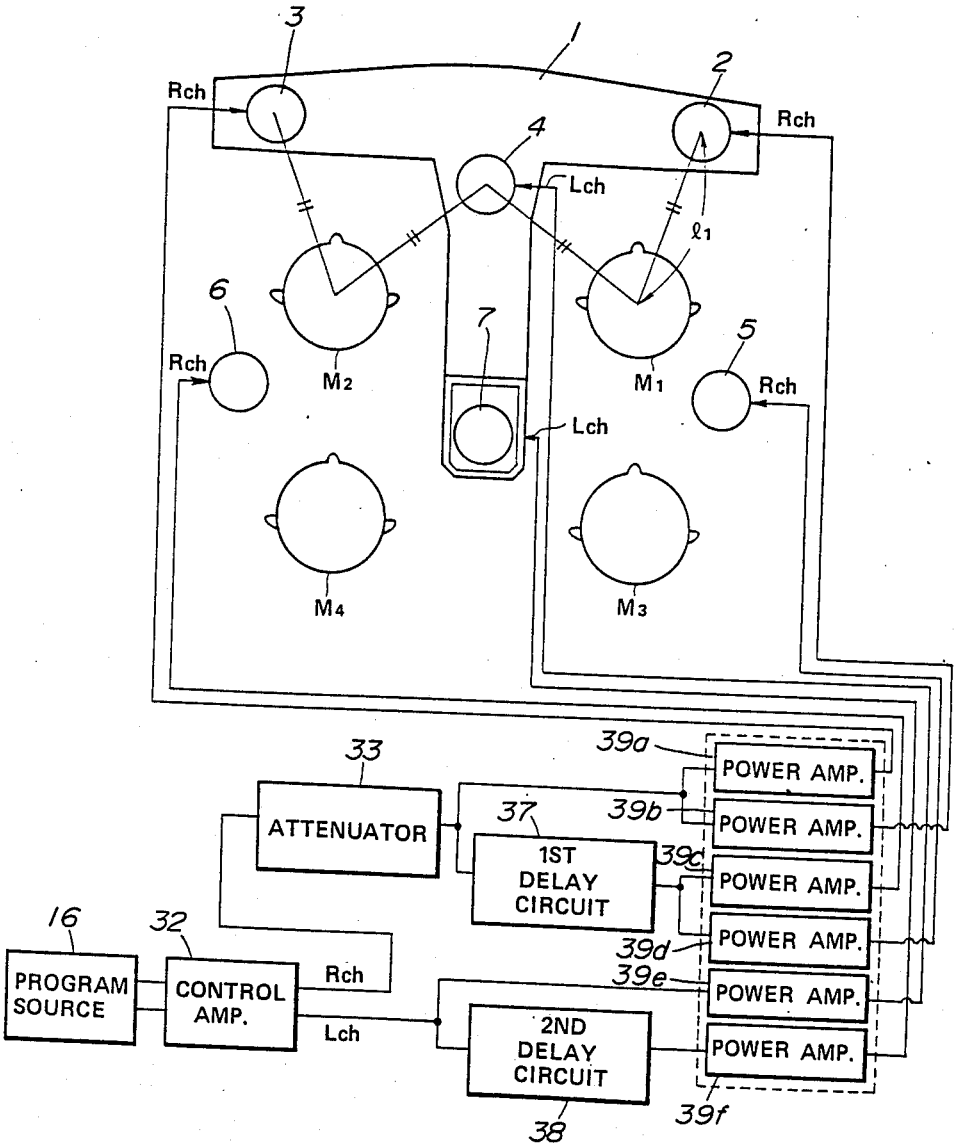
FIG. 6 is a schematic diagram showing a modified form of the second embodiment.

Referring to FIG. 6, there is illustrated a modified form of the stereophonic signal generator circuit of the second embodiment. In this modification, the second and third attenuating circuits 34 and 35 are removed and replaced by first and second delay circuits 37 and 38, respectively. The first and second delay circuits 37 and 38 provide the same time delay with respect to their input signals. The power amplifiers 39*c* and 39*d* receive an R signal delayed a predetermined time with respect to the R signal applied to the power amplifiers 39*a* and 39*b*. Similarly, the power amplifier 39*f* receives an L signal delayed the predetermined time with respect to the L signal applied to the power amplifier 39*e*. As a result, the rear loudspeakers 5, 6 and 7 receive drive signals delayed the predetermined time with respect to the drive signals applied to the front loudspeakers 2, 3 and 4, respectively.

For the passengers M1 and M2, the stereophonic sound image can be located at a proper location in front of each of the passengers in the same fashion as discussed in connection with FIGS. 4 and 5. The location of the stereophonic sound image is free from the influence of the sound produced from the rear loudspeakers due to a "harness effect" since the first and second delay circuits 37 and 38 delay the arrival of sound from the rear loudspeakers to the passengers M1 and M2 with respect to the arrival of sound from the front loudspeakers to the passengers M1 and M2.

With respect to the passenger M3 seater on the right-hand rear seat, the rear loudspeakers 5 and 7 are positioned at the same distance ($l_2$). Since the delay circuits 37 and 38 provide the same delay with respect to the R and L signals to the power amplifiers 39*d* and 39*f*, the R sound produced from the right-hand rear loudspeaker 5 and the L sound produced from the center rear loudspeaker 7 will arrive the passenger M3 at the same time. As a result, a stereophonic sound image is positioned at a proper location in front of the passenger M3. Similar considerations are applicable for the passenger M4 seated on the left-hand rear seat. Since the volumes of sound produced from the rear loudspeakers 5, 6 and 7 are substantially the same as the volumes of sound produced from the front loudspeakers 2, 3 and 4, respectively, the passengers M1 to M4 can listen reproduced stereophonic sound under the same condition.

Although the attenuating circuits are used in the circuit of FIG. 5 and the delay circuits 37 and 38 are used in the circuit of FIG. 6 for minimizing the influence of sound produced from the rear loudspeakers on the localization of a stereophonic sound image for each of the passengers M1 and M2 seated on the vehicle front seats, it is to be noted that the attenuation circuits 34 and 35 and the delay circuits 37 and 38 may be used in a single circuit in order to insure avoidance of the influence.

Figure 7:
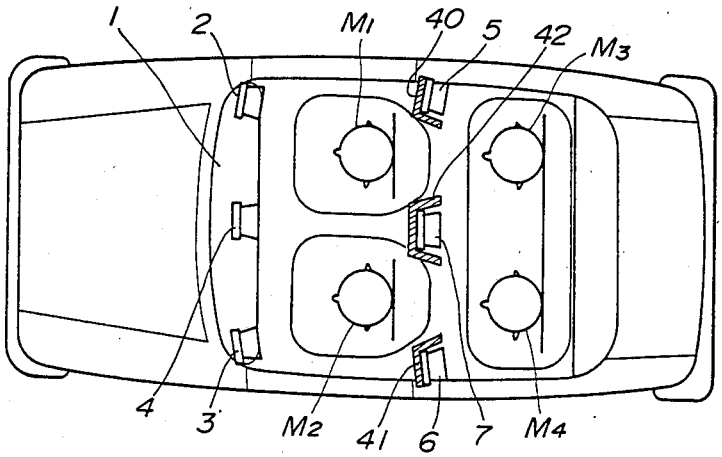
FIG. 7 is a top plan view showing another modified form of the second embodiment.

Referring to FIG. 7, there is illustrated another modification of the second embodiment which can eliminate the need for the attenuating circuits 34 and 35 as used in the circuit of FIG. 5 or for the delay circuits 37 and 38 as used in the circuit of FIG. 6. In this modification, sound shield members 40, 41 and 42 are provided for the respective rear loudspeakers 5, 6 and 7 to minimize sound radiation from the rear loudspeakers to the passengers M1 and M2 seated on the vehicle front seats. This can minimize the influence of sound produced from the rear loudspeakers 5, 6 and 7 on the localization of a stereophonic sound image for each of the passengers M1 and M2 seated on the vehicle front seats. In addition, the volume of sound produced from the rear loudspeakers 5, 6 and 7 may be equal to or greater than the volume of sound produced from the front loudspeakers 2, 3 and 4, respectively. It is, therefore, possible to control the volume of sound produced from the rear loudspeakers independently of the volume of sound produced from the front loudspeakers.

Figure 8:
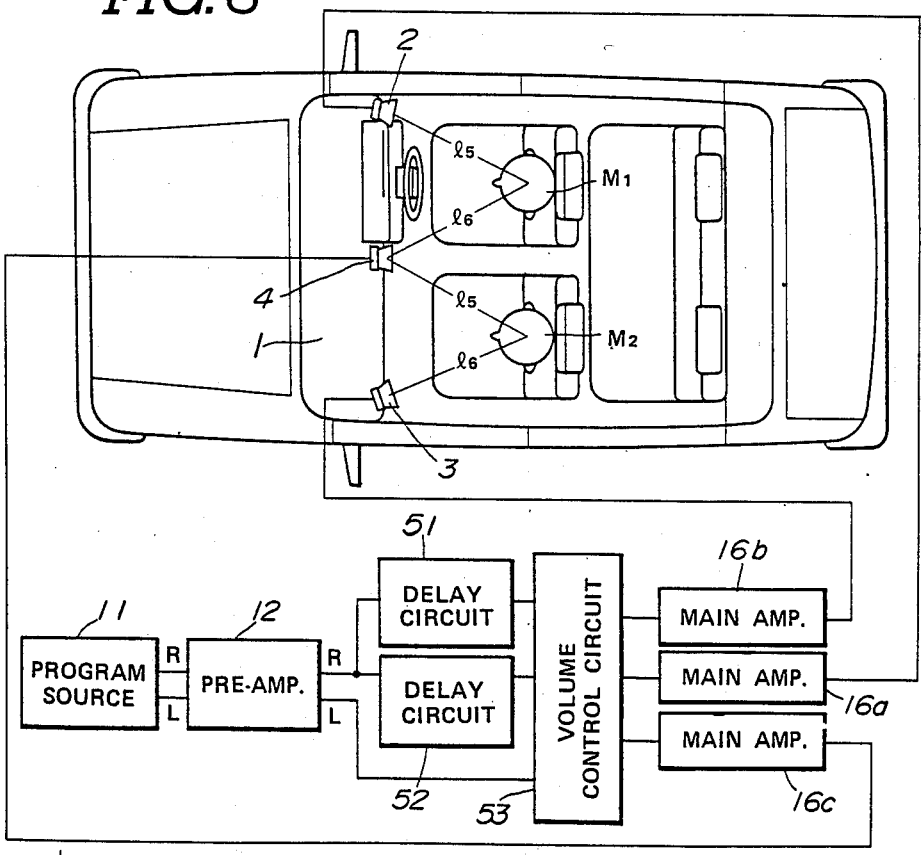
FIG. 8 is a schematic diagram showing a third embodiment of the present invention.

Referring to FIG. 8, there is illustrated a third embodiment of the present invention. The right-hand loudspeaker 2 is located relative to the right of the passenger M1 seated on the right-hand front seat. The right-hand loudspeaker 2 is positioned a distance ($l_5$) away from the passenger M1. The left-hand loudspeaker 3 is located relative to the left of the passenger M2 seated on the left-hand front seat. The left-hand loudspeaker 3 is positioned at a distance ($l_6$) away from the passenger M2. The center loudspeaker 4 is located between the right- and left-hand loudspeakers 2 and 3 at a distance ($l_6$) from the passenger M1 and at a distance ($l_5$) from the passenger M2. These distances are determined according to the fashion in which parts are arranged on the instrument panel 1. The loudspeakers 2, 3 and 4 are connected to receive stereophonic signal from a stereophonic signal generator circuit for acoustical reproductions of stereophonic sound corresponding to the stereophonic signals.

The stereophonic signal generator circuit includes a pre-amplifier 12 which receives stereophonic signals from a program source 11. The pre-amplifier 12 generates R and L signals at its R- and L-channel outputs. The R signal is fed to a time delay circuit 51 and also to another time delay circuit 52. These time delay circuits 51 and 52 provides a predetermined time delay, for example, ranging from 0.3 msec to 0.6 msec to their input signals. The delayed signals are fed through a volume control circuit 53 to the main amplifiers 16*a* and 16*b* which drive the right- and left-hand loudspeakers 2 and 3, respectively. The L signal is fed from the pre-amplifier 12 through the volume control circuit 53 to the main amplifier 16*c* which drives the center loudspeaker 4.

With respect to the passenger M1 seated on the right-hand front seat, the right-hand loudspeaker 2 is positioned at a distance ($l_5$) and the center loudspeaker 4 is positioned at a distance ($l_6$). It is now assumed that the distance ($l_5$) is smaller than the distance ($l_6$) and the difference of the distance ($l_5$) from the distance ($l_6$) is in the range of about 10 cm to about 20 cm.

If the R and L sounds are produced at the same time from the right-hand and center loudspeakers 2 and 4, the L signal will arrive at the passenger M1 with a time lag relative to the arrival of the R signal at the passenger M1 because of the difference of the distance ($l_5$) from the distance ($l_6$). If the distance ($l_6-l_5$) is in the range of about 10 cm to about 20 cm, the time lag will be in the range of about 0.3 msec to about 0.6 msec, causing such a "harness effect" that a sound image is located in a direction of travel of the sound which comes to a lstener earlier. It is known in the art that such a "harness effect"

will occur when the time lag is in the range of 0.4 msec to 40 msec. A listener will have a sense of oppression due to the preceeding sound if the time lag is less than 1 msec and particularly in the range of 0.3 msec to 0.6 msec.

In this embodiment, the time delay circuit 51 is arranged to provide a time delay ranging from 0.3 msec to 0.6 msec to the R-channel signal which drives the right-hand loudspeaker 2. Consequently, the L sound produced from the center loudspeaker 4 can arrive at the passenger M2 at the same time when the R sound produced from the right-hand loudspeaker 2 arrives at the passenger M1. This permits creation of a stereophonic sound image in front of the passenger M1. The passenger M2 can have a stereophonic sound image in front of him in a similar manner.

Figure 9:
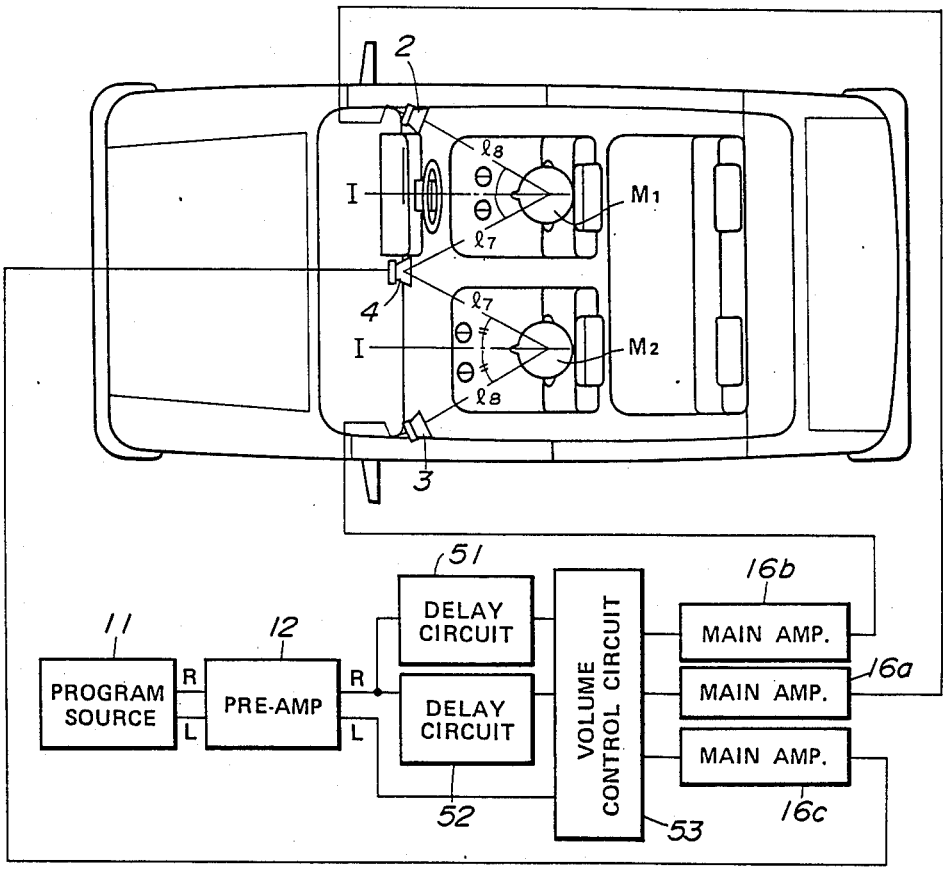
FIG. 9 is a schematic diagram showing a modified form of the third embodiment.

Referring to FIG. 9, there is illustrated a modified form of the second embodiment, wherein the right- and left-hand loudspeakers are mounted at such positions as to permit an increased distance between the adjacent loudspeaker to widen the acoustic field. The right-hand loudspeaker 2 is located at such a position that it has a primary acoustical axis directed to the passenger M1, the primary acoustical axis making the same angle ($\theta$) with respect to the front of the passenger M1, as indicated by line I, as the angle ($\theta$) of the line connecting the center loudspeaker 4 and the passenger M1 with respect to the front of the passenger M1. The left-hand loudspeaker 3 is located at such a position that it has a primary acoustical axis directed to the passenger M2, the primary acoustical axis making the same angle ($\theta$) with respect to the front of the passenger M2, as indicated by line I, as the angle ($\theta$) of the line connecting the center loudspeaker 4 and the passenger M2 with respect to the front of the passenger M2. The right- and left-loudspeakers 2 and 3 are preferably at the same height as the center loudspeaker 4. Each of the time delay circuits 51 and 52 provides a time delay to the R signal. The provided time delay is given as:

$$\Delta t\ (sec) = (l_7 - l_8)\ (m)/340\ (m/sec)$$

Figure 10:
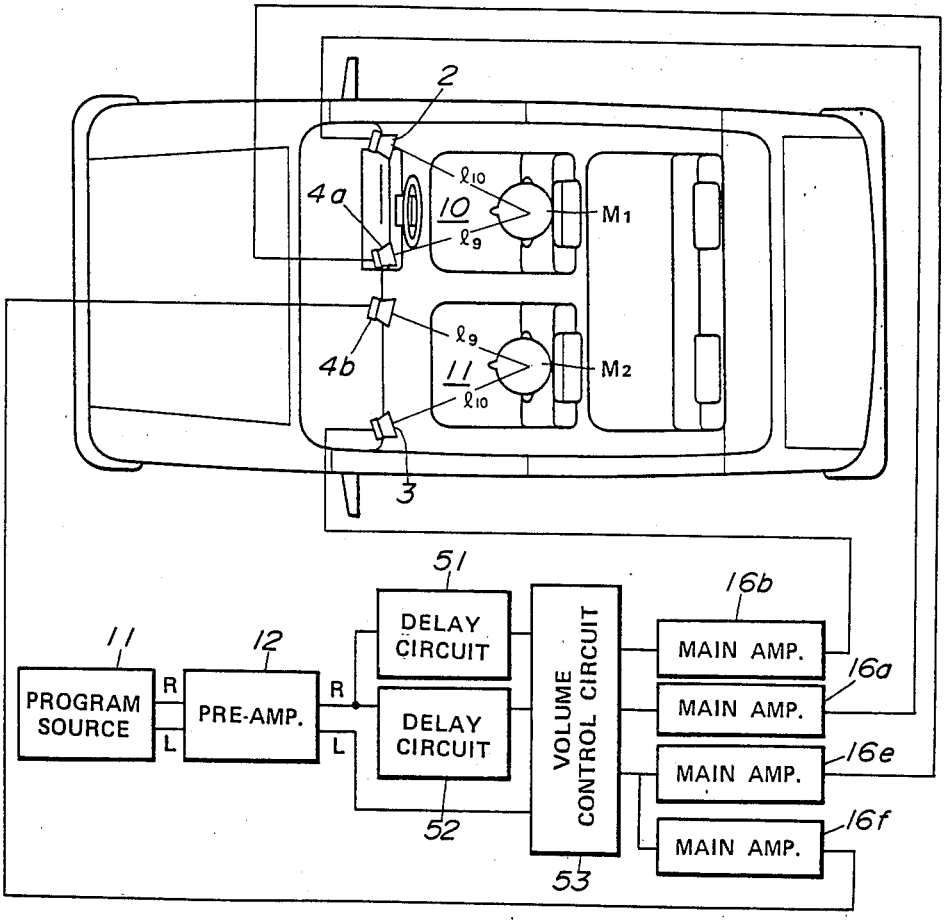
FIG. 10 is a schematic diagram showing another modified form of the third embodiment.

Referring to FIG. 10, there is illustrated another modification of the second embodiment, wherein two center loudspeakers are provided. A first center loudspeaker **4*a* is positioned between the right- and left-hand loudspeakers 2 and 3. The first center loudspeaker 4*a* has a primary acoustical axis directed to the passenger M1 seated on the right-hand front seat. The second loudspeaker 4*b* is positioned between the first center loudspeaker 4*a* and the left-hand loudspeaker 3. The second center loudspeaker 4*b* has a primary acoustical axis directed to the passenger M2 seated on the left-hand front seat. The L signal is applied from the preamplifier 12 through the volume control circuit 53 to a main amplifier 16*e* which drives the first center loudspeaker 4*a* and also to a main amplifier 16*f* which drives the second center loudspeaker 4*b***. This modification permits high-quality reproductions of stereophonic signals without frequency characteristic deviation.

Although the present invention has been described in connection with a vehicle compartment, it is to be noted that it is not limited to such an application and is applicable to other compartments such as a listening room having restricted listening position. In addition, the R signal may be applied to drive the center loudspeaker(s) in which case the L signal is fed to drive the right- and left-hand loudspeakers.

While the present invention has been described in conjunction with specific embodiments thereof, it is evident that many alternatives, modifications and variations will be apparent to those skilled in the art. Accordingly, it is intended to embrace all alternatives, modifications and variations that fall within the broad scope of the appended claims.

What is claimed is:

1. A system for reproducing stereophonic signals to create a stereophonic sound image in front of each of first and second listeners sitting side by side in a compartment, comprising:

a right-hand loudspeaker positioned relative to the right of the first listener sitting on the right:

a left-hand loudspeaker positioned relative to the left of the second listener sitting on the left;

a center loudspeaker positioned between the right- and left-hand loudspeaker; and a signal generator circuit for generating R and L stereophonic signals, one of the R and L signals being applied to drive the right-hand loudspeaker and also the left-hand loudspeaker, the other signal being applied to drive the center loudspeaker, the signal generator circuit including first control means for controlling the magnitude of the one signal to the right-hand loudspeaker and second control means for controlling the magnitude of the one signal to the left-hand loudspeaker, said first control means being operable in first and second directions respectively to increase and decrease the magnitude of the one signal to the right-hand loudspeaker, said first control means being further operable to decrease the magnitudes of the one signal to the left-hand loudspeaker and the other signal to the center loudspeaker when it is operated in the first direction and to increase the magnitudes of the one signal to the left-hand loudspeaker and the other signal to the central loudspeaker when it is operated in the second direction, said second control means being operable in first and second directions respectively to increase and decrease the magnitude of the one signal to the left-hand loudspeaker, said second control means being further operable to decrease the magnitudes of the one signal to the right-hand loudspeaker and the other signal to the center loudspeaker when it is operated in the first direction and to increase the magnitude of the one signal to the right-hand loudspeaker and the magnitude of the other signal to the central loudspeaker when it is operated in the second direction.

2. The system as claimed in claim 1, wherein each of the first and second control means is operable to control the magnitude of the one signal to a corresponding loudspeaker without altering the relative magnitudes of the one signal to the other loudspeaker and the other signal to the center loudspeaker.

3. A system for reproducing stereophonic signals to create a stereophonic sound image in front of each of first, second, third and fourth listeners sitting in a compartment, the first and second listener sitting on right- and left-hand front seats, the third and fourth listeners sitting on right- and left-hand rear seats, comprising:

a right-hand front loudspeaker positioned relative to the right of the first listener;

a left-hand front loudspeaker positioned relative to the left of the second listener;

a center front loudspeaker positioned between the right- and left-hand front loudspeakers;

a right-hand rear loudspeaker positioned relative to the right of the third listener;

a left-hand rear loudspeaker positioned relative to the left of the fourth listener;

a center rear loudspeaker positioned between the right- and left-hand rear loudspeakers;

a signal generator circuit for generating R and L stereophonic signals, one of the R and L signals being applied to drive the right- and left-hand front loudspeakers and the right- and left-hand rear loudspeakers, the other signal being applied to drive the center front loudspeaker and the center rear loudspeaker, the signal generator circuit including first means for attenuating the one signal to the right- and left-hand front loudspeakers and also to the right-and left-hand rear loudspeakers;

second means for attenuating sound produced from the right- and left-hand rear loudspeakers; and third means for attenuating sound from the center rear loudspeaker.

4. The system as claimed in claim 3, wherein the second means includes first and second sound shield members provided for the right- and left-hand rear loudspeakers for attenuating sound radiation toward the first and second listeners, and the third means includes a third shield member provided for the center rear loudspeaker for attenuating sound radiation toward the first and second listeners.

5. The system as claimed in claim 4, wherein the second means includes an attenuating circuit for attenuating the one signal to drive the right- and left-hand rear loudspeaker, and the third means includes an attenuating circuit for attenuating the other signal to drive the center rear loudspeaker.

6. A system for reproducing stereophonic signals to create a stereophonic sound image in front of each of first, second, third and fourth listeners sitting in a compartment, the first and second listeners sitting on right- and left-hand front seats, the third and fourth listeners sitting on right- and left-hand rear seats, comprising:

a right-hand front loudspeaker positioned relative to the right of the first listener;

a left-hand front loudspeaker positioned relative to the left of the second listener;

a center front loudspeaker positioned between the right- and left-hand front loudspeakers;

a right-hand rear loudspeaker positioned relative to the right of the third listener;

a left-hand rear loudspeaker positioned relative to the left of the fourth listener;

a center rear loudspeaker positioned between the right- and left-hand rear loudspeakers;

signal generator circuit for generating R and L stereophonic signals, one of the R and L signals being applied to drive the right- and left-hand front loudspeakers and the right- and left-hand rear loudspeakers, the other signal being applied to drive the center front loudspeaker and the center rear loudspeaker, the signal generator circuit including first means for attenuating the one signal to the right- and left-hand front loudspeakers and also to the right-and left-hand rear loudspeakers;

second means for delaying sound produced from the right- and left-hand rear loudspeakers; and third means for delaying sound from the center rear loudspeaker.

7. The system as claimed in claim 6, wherein the second means includes a delay circuit for providing a predetermined time delay to the one signal to drive the right- and left-hand rear loudspeakers, and the third means includes a delay circuit for providing the predetermined time delay to the other signal to drive the center rear loudspeaker.

8. The system as claimed in claim 6, wherein the second means includes first and second sound shield members provided for the right- and left-hand rear loudspeakers for attenuating sound radiation toward the first and second listeners, and the third means includes a third shield member provided for the center rear loudspeaker for attenuating sound radiation toward the first and second listeners.

* * * * *